United States Patent [19]

Böcker

[11] Patent Number: 4,640,387

[45] Date of Patent: Feb. 3, 1987

[54] ELEVATOR COMPRISING TELESCOPIC SECTIONS, AND A LOCKING DEVICE THEREFOR

[75] Inventor: Albert Böcker, Werne, Fed. Rep. of Germany

[73] Assignee: Firma Albert Bocker GmbH & Co. Kg., Fed. Rep. of Germany

[21] Appl. No.: 807,167

[22] Filed: Dec. 9, 1985

[30] Foreign Application Priority Data

Dec. 12, 1984 [DE] Fed. Rep. of Germany ..... 3445244
Jan. 12, 1985 [DE] Fed. Rep. of Germany ..... 3500841

[51] Int. Cl.[4] ..... E06C 7/06
[52] U.S. Cl. ..... 182/213; 182/66
[58] Field of Search ..... 182/213, 212, 209–211, 182/63, 66

[56] References Cited

U.S. PATENT DOCUMENTS

| | | | |
|---|---|---|---|
| 304,420 | 9/1884 | Fox et al. | 182/213 |
| 326,205 | 9/1885 | Derby | 182/212 |
| 349,370 | 9/1886 | Springer | 182/212 |
| 369,084 | 8/1887 | Smith | 182/213 |
| 1,277,504 | 9/1918 | Tanner | 182/212 |
| 2,164,575 | 7/1939 | Colberg | 182/213 |
| 2,210,803 | 8/1940 | Dunn | 182/213 |
| 2,310,441 | 2/1943 | Klum | 182/213 |
| 2,853,221 | 9/1958 | Troche | 182/213 |
| 4,364,451 | 12/1982 | Wright | 182/213 |

*Primary Examiner*—Reinaldo P. Machado
*Attorney, Agent, or Firm*—George A. Evans, Sr.

[57] ABSTRACT

The invention relates to a locking device between two relatively movable telescopic sections of an elevator such as a scaffolding or load hoist. The individual telescopic sections are locked together by a locking dog. The locking system can be arranged to snap in automatically, and to be released by cable actuation, or vice versa. The locking dog is actuated by a draw cable which controls a locking/release cable. The cable stretch of the draw cable is compensated by a tackle block reversal thereof, that is to say a substantially greater shortening takes place (with reduced force application) in the draw cable compared with the locking-/release cable. Thus, a mechanical advantage is obtained not only within the draw cable itself, but also between the draw cable and the locking/release cable.

16 Claims, 9 Drawing Figures

ELEVATOR COMPRISING TELESCOPIC SECTIONS, AND A LOCKING DEVICE THEREFOR

BACKGROUND TO THE INVENTION

This invention relates to an elevator constituted by a plurality of telescopic sections, positively guided on one another, and to a locking device therefor.

In a known elevator of this type, each telescopic section is formed as a ladder, and is lockable against retraction with respect to the adjacent telescopic section, in several positions of extension, by means of a respective locking device. Each locking device includes at least one cable-actuated, spring-loaded, pivotable locking dog. Each locking dog is provided with a support member for the adjacent telescopic section. The locking dogs are actuated by draw cables which actuate locking cables attached to movably mounted intermediate members.

DE-PS No. 3 001 410 describes an elevator of this type, the elevator comprising a rail for the guidance of a load container. In this case, on actuation of a winch, several telescopic sections are extended, moving in relation to one another. An actuator is provided at an operating position, the actuator acting via a corresponding draw cable to actuate the locking device which locks all the telescopic sections together. Locking, is thus, effected through a manually-actuated draw cable. After the locking has been released by the same draw cable, the locking device remains, under spring loading, in the unlocked position. For the transmission of the cable traction from one telescopic section to the next, pivotable bodies are used which permit only a slight "shortening" of each cable. In this case, it is disadvantageous that a considerable force must be applied for the actuation of the pivotable bodies, while only a slight shortening of the draw cable is possible. This causes an imprecise response of the locking system, because the cable shortening caused by the pivotable bodies is largely compensated by the cable stretch of the draw cable, which is substantially longer than the locking cable. This major cable stretch does not exist in the shorter locking cable.

DE-OS No. 2 519 513 describes a sliding ladder which consists of a lower ladder and an upper ladder. The relative displacement of the two ladder parts takes place by cable actuation, but by hand. In this case, a pivotable snap-in lever is mounted on the lower ladder, which remains at rest. The pivotable snap-in lever is of two-armed formation, the support face of one arm engaging under a side of the lower ladder, and the support face of the other arm engaging under the respective side of the upper ladder. During displacement of the upper ladder in the direction of extension, the snap-in lever can move aside against the force of a spring. In order to release the locking device, the draw cable must be brought into a position situated laterally of the lower ladder. Thus, this is not a suitable arrangement for locking the telescopic sections of an elevator. Moreover, in order to retract this ladder, it is firstly necessary to relieve the locking device (by raising the upper ladder by a specific amount), so that the locking device can pivot into the unlocked position. The locking device of this ladder is, therefore, usable only with relatively light sliding ladders.

The aim of the invention is to provide an improved version of the elevator and locking device described in DE-PS No. 3 001 410. In particular, it is an object of the invention to make a locking device still simpler and more reliable.

Another object is to ensure that the cable guidance necessary for the actuation of the locking device should be of such configuration that a reliable response of the release cable (and thus of the unlocking of the device) is guaranteed.

Yet another object is that the actuation of the locking device should be achieved with the minimum expenditure of force.

A stilll further object is to compensate for the differing lengths of the draw cable and of the locking cable (and the consequent differing cable elongation under stress) by a "mechanical advantage" between the two cables.

SUMMARY OF THE INVENTION

The present invention provides a locking device for locking together a pair of adjacent telescopic sections of an elevator having a plurality of telescopic sections which are positively guided on one another, each telescopic section being of ladder-like formation having a pair of rails and a plurality of rungs extending between said rails, the locking device including a cable-actuated pivotable locking dog associated with one of said pair of telescopic sections, the locking dog being provided with a support member for the other of said pair of telescopic sections, the locking dog being actuated by a draw cable which actuates a locking/release cable attached to a movably-mounted intermediate member associated with said other telescopic section, wherein the intermediate member is provided with a fixed pulley and a movable pulley, the locking dog is mounted for movement in a direction towards an unlocked position and in a direction towards a locked position, movement in one of said directions being a srping-loaded movement, and movement in the other of said directions being under the action of the draw cable, the locking-/release cable being connected to the movable pulley, and the draw cable passing around the fixed pulley and around the movable pulley.

The invention also provides an elevator having a plurality of telescopic sections which are positively guided on one another, each telescopic section being of ladder-like formation having a pair of rails and a plurality of rungs extending between said rails, each pair of adjacent telescopic sections being lockable together by a respective locking device in a plurality of positions of extension, each locking device including a cable-actuated pivotable locking dog associated with one telescopic section of the associated pair of telescopic sections, each locking dog being provided with a support member for the other telescopic section of said pair of telescopic sections, each locking dog being actuated by a respective draw cable which actuates a respective locking/release cable attached to a movably-mounted intermediate member associated with said other telescopic section of said associated pair of telescopic sections, the improvements comprising constructing each of the locking devices by (a) providing each of the intermediate members with a fixed pulley and a movable pulley, (b) mounting each of the locking dogs for movement in a direction towards an unlocked position and in a direction towards a locked position, movement in one of said directions being a spring-loaded movement, and movement in the other of said directions being under the action of the associated draw cable, (c) connecting each locking/release cable to the associated movable pulley, and (d) passing the draw cable of each telescopic section around the associated fixed pulley and around the associated movable pulley.

Thus, each movable pulley is connected by its locking/release cable to the asociated locking dog engaging between the individual telescopic sections, while the associated draw cable is conducted in tackle block manner around the associated fixed pulley and the associated movable pulley. In this way, each draw cable receives a "mechanical advantage" as regards its movement. This is because each draw cable (which is longer than the associated locking/release cable and may be conducted around several reversal points) experiences a greater variation of length than said locking/release cable. Thus, a further mechanical advantage takes place between each draw cable and the associated locking-/release cable. As a result of the reversal of each draw cable in tackle block manner, only a light pull has to be exerted upon it in order to actuate the associated locking/release cable. Owing to the greater variation of the effective length of each draw cable, the cable elasticity and the "slack" at the reversal points are better compensated. As a result, a more reliable and simpler operation of the release system is realised.

When the locking dogs are latches, these may be situated on the (relatively) extending telescopic sections, and run over the (relatively) stationary telescopic sections in such a manner that their support faces are supported from above on the rungs of the (relatively) stationary telescopic sections. The locking takes place in a manner known per se automatically under spring loading. On the other hand, release occurs due to the special formation of the movably-mounted intermediate members as tackle blocks, in combination with the attachment of the release cables to the tackle blocks. Locking devices of this type have proved their value not only in oblique hoists but especially also in scaffolding hoists.

The formation of the intermediate members as tackle blocks further guarantees, with low expenditure of force, a reliable transmission of the cable length variation to the following telescopic sections.

The movable pulley of each locking device can act directly or indirectly upon the associated locking-/release cable, while the locking dogs can be arranged in the upper or lower regions of the telescopic sections. According to an earlier proposal of the Applicant, the locking dogs can be arranged on a control cam which deviates against spring force into the unlocking position, or can pivot under spring force into the unlocking position. The locking dogs, on the other hand, preferably snap under spring loading into the locked position, and are brought into the release position by means of the draw cable.

Preferably each locking dog is a spring-loaded latch positioned at that end of the associated said one telescopic section adjacent to the associated said other telescopic section to be locked thereto, each latch being spring-loaded towards the locked position, and each latch being movable towards the unlocked position by a release cable one end of which is attached to the associated movable pulley. In this case, it is merely necessary for the locking to be "applied" manually at the operating position. The locking system here snaps in between the support members (for example the rungs) of the telescopic sections. On further extension of the telescopic sections, however, no release from the operating position is necessary. This release takes place automatically by the rungs of the extending telescopic sections running over the dogs, which snap in again automatically, after overrunning, so that security against unintended relative retraction of the telescopic sections is guaranteed at all times. It is self-evident, that the distance between the two adjacent rungs must be so great that snapping in of the dogs between the rungs is rendered possible. The unlocking is effected, and the retraction of the telescopic sections is made possible, only by an additional action from the operating position. Thus, the unlocking and relocking, by hand from the operating position, hitherto necessary at every extension of the telescopic elevator, is eliminated. Thus, the operation is further simplified and security is increased.

Advantageously, the other end of each release cable acts on the latch, the associated movable pulley being variable in position by the associated draw cable. Thus, each draw cable acts via the associated movable pulley directly upon the associated release cable.

Conveniently, the fixed pulley and the movable pulley of a given telescopic section serve to guide the draw cable associated with the adjacent telescopic section, the end of said draw cable passing around said fixed pulley leading to the upper end of the adjacent telescopic section, and the end of the cable passing around said movable pulley leading to the lower end of said adjacent telescopic section. Thus, each draw cable is so guided that the pull exerted therefrom is transmitted to the next draw cable, as a result of the mechanical advantage. Here, the mechanical advantage is especially advantageous, because the cable lengths and the "slack" of the individual reversal points are cumulative, and can be adequately compensated by the mechanical advantage.

In a preferred embodiment, each latch includes two latching members which are connected together by a rigid spindle, said other end of the associated release cable acting on said spindle. Each latching member can, therefore, run with a relatively short deflector face over the rungs of the adjacent telescopic section, and snap automatically into the locking position after running over the rungs. Advantageously, each of the latching members is provided with a stop for limiting pivoting of that latching member. The stops limit both the snapping-in in the locking direction, and the pivoting movement in the unlocking direction by the release cable.

Preferably, each of the latching members is rotatably mounted on a bearing journal fixed to a respective rail of the associated telescopic section. Advantageously, at least one bearing journal of each locking device serves to mount a locking spring, said locking spring acting between a transverse member of the associated telescopic section and the associated latching member. This permits automatic pivoting of the latching members into the locking position. The locking springs are so designed that, on appropriate traction in the release cables, the force of the locking springs is overcome, and the locking devices can be actuated in the "release" direction.

Advantageously, a tension spring is arranged between the spindle and the release cable of each locking device. Such a tension spring serves to compensate for the cable tension.

In another preferred embodiment, each latch includes a plurality of locking dogs. In principle, it is sufficient if each locking device has only one locking dog which can snap in after running over a rung. However, in order to be able to lock effectively on shorter travel distances, the provision of several locking dogs per latch is advantageous. Preferably, each latch is mounted, via rocker levers, on a rail of the associated telescopic section. Thus, each latch may be of saw-tooth formation, and the locking system can snap in effectively each time after running over a saw tooth.

Preferably, the free end of each draw cable is attached to an articulation point provided on a pivotable beam, said pivotable beam being articulated to a rung of the associated telescopic section, and serving to mount the movable pulley of the associated locking device. Thus, the locking/release cable can transmit the pivoting movement to cam carriers with the desired mechanical advantage between the two cables.

Conveniently, the locking/release cable of each locking device is guided between the stub shafts of a dog carrier over reversing pulleys mounted on the associated pivotable beam and on the associated rung.

The invention is not limited to the use in load hoists formed as oblique hoists, but finds particular use in scaffolding hoists where the extending telescopic sections extend out as a "pack", that is to say without the occurrence of a simultaneous relative movement of the sections.

BRIEF DESCRIPTION OF THE DRAWINGS

Two forms of elevator, each if which is constructed in accordance with the invention, will now be described, by way of example, with reference to the accompanying drawings, in which:-

DESCRIPTION OF PREFERRED EMBODIMENTS

Figure 4:
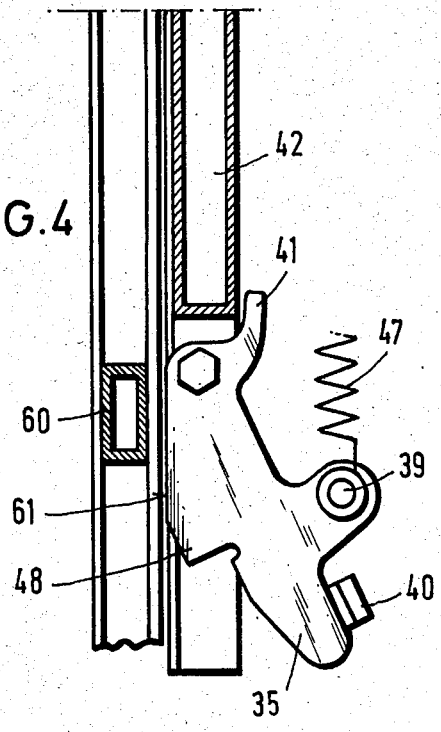
FIG. 4 shows the latch of FIGS. 2 and 3 in the unlocked position.
Figure 5:
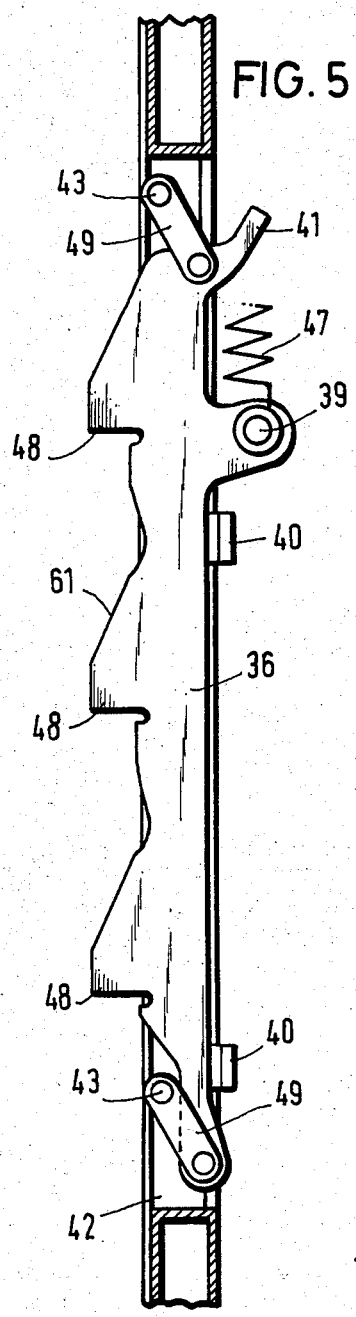
FIG. 5 is a side elevation of the latch (together with a plurality of support dogs) in the locked position.
Figure 6:
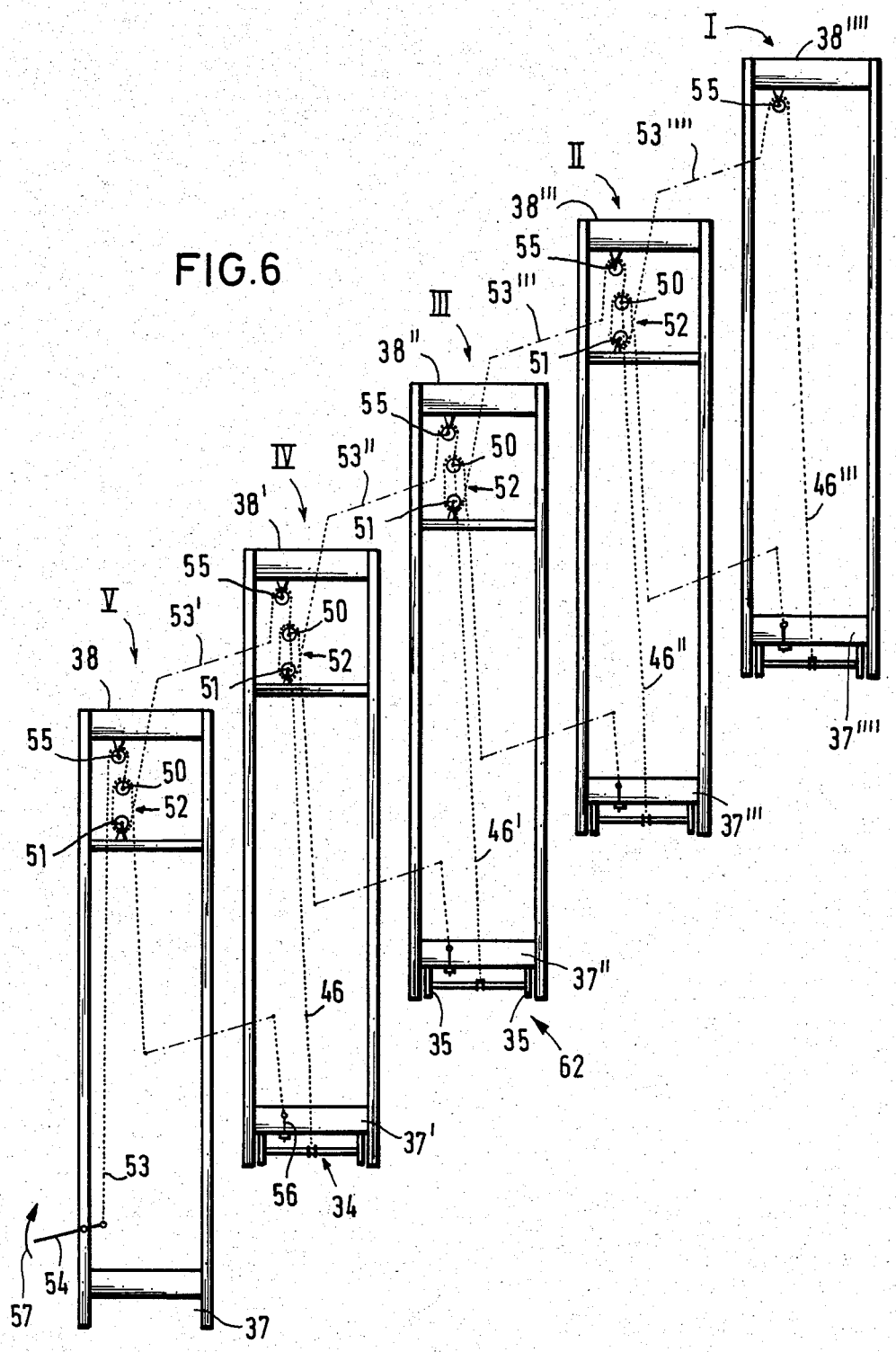
FIG. 6 is an exploded view of the first form of elevator, and shows the cable course of the locking devices.

Referring to the drawings, FIGS. 1 to 6 show an elevator constituted by five telescopic sections I, II, III, IV and V. A respective locking device 34 is arranged between each adjacent pair of telescopic sections. The locking devices 34 are arranged in the region of the lower ends 37', 37'', 37''' and 37'''' of the telescopic sections IV, III, II and I. As shown in FIG. 6 the last (lowermost) telescopic section is section V, and the references IV, III, II and I designate respectively the following telescopic sections. Each section I to V is of ladder configuration being constituted by a pair of rails 42 and a plurality of rungs 60.

A draw cable 53 (see FIG. 6) is provided to operate the locking devices 34. The draw cable 53 is connected, in the region of the lower end 37 of the telescopic section V, to a handle 54. The draw cable 53 then passes round a reversing pulley 55 in the region of the upper end 38 of the telescopic section V. It then passes round a movable pulley 50 of a tackle block 52, the tackle block consisting of the movable pulley 50 and a fixed pulley 51. A further draw cable 53' passes round the pulleys 50 and 51. One end of the cable 53' leads to the upper end 38' of the telescopic section IV, the other end of the cable 53' leading to the lower end 37' of the telescopic section IV, where it is made fast by means of a tensioner device 56 (see FIG. 1).

As shown in FIG. 6, a release cable 46 acts on the movable pulley 50. On actuation of the draw cable 53', the release cable 46 actuates the locking device 34 in the "unlocking" direction.

Thus, on actuation of the handle 54 in the direction of the arrow 57, the pull upon the cable 53 is transmitted via the reversing pulley 55 to the movable pulley 50 of the telescopic section V, and hence to the cable 53'. the latter, will in turn, shift the movable pulley 50 of the telescopic section IV, so that the locking device 34 between the two sections V and IV is released by the release cable 46. By virtue of similar draw cables 53'', 53''', and 53'''' and similar release cables 46', 46'' and 46''', the remaining locking devices 34 will also be released. The pull exerted upon the draw cable 53 thus acts upon all the draw cables 53' to 53'''' guided over the reversing pulleys 55 at the upper ends 38 to 38'''' of the telescopic sections I to V, and thus upon the associated release cables 46 to 46'''.

Figure 1:
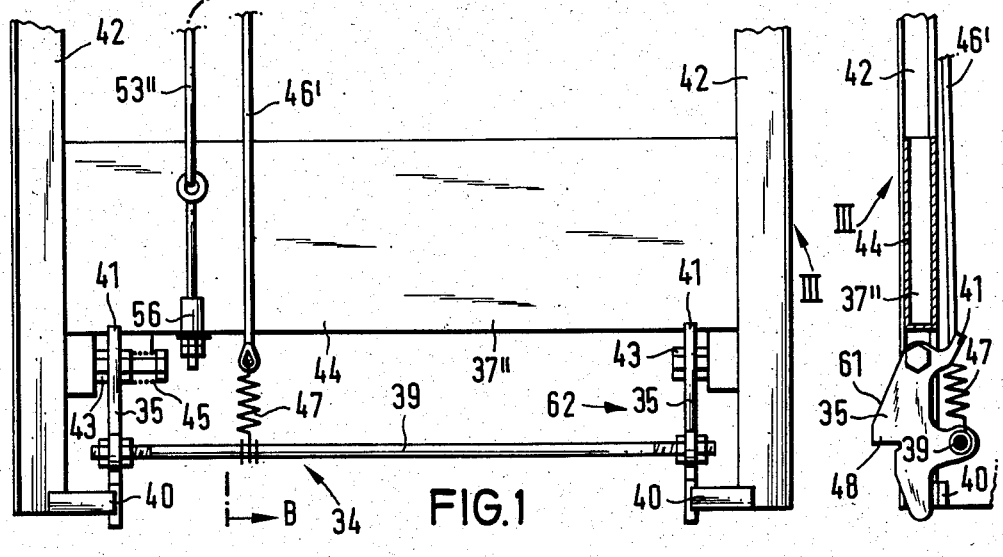
FIG. 1 is a front-elevation of the adjoining ends of two adjacent telescopic sections of the first form of elevator.
Figure 3:
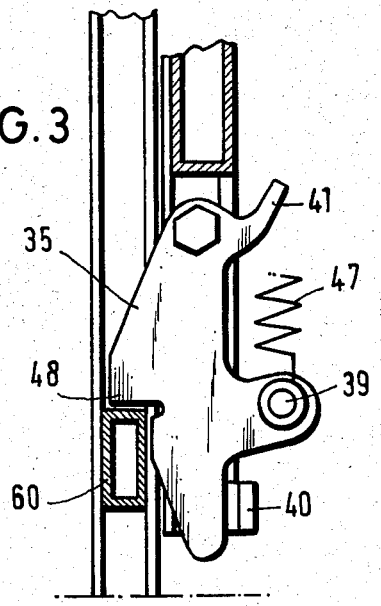
FIG. 3 shows the latch of FIG. 2 in the locked position.

Part of the cable course can be seen in detail in FIG. 1. This figure also shows details of the locking device 34 which locks the telescopic sections IV and III together. The other locking devices 34 are similar, so only this locking device will be described in detail. The upper edge 38' of the telescopic section IV is shown at the top of this figure. The draw cable 53' coming from the preceding telescopic section V (not shown) runs round the reversing pulley 55, which is rotatably arranged at a fixed position on a transverse member 59 of the telescopic section IV. The cable 53' is guided towards the movable pulley 50. The release cable 46 is attached to the spindle 58 of the movable pulley 50. The release cable 46 is conducted to the lower end of the telescopic section IV, where it is attached via a spring 47 to the spindle 39 of a latch mechanism 35 (see below).

The fixed pulley 51 is arranged on a rung 60 of the telescopic section IV. The draw cable 53'' passes round both pulleys 50 and 51, the upper end of this cable leading to the upper end 38'' of the telescopic section III (see FIG. 6), and the lower end leading to the lower end 37'' of the telescopic section III, as shown at the bottom of FIG. 1. FIG. 1 also shows that the release cable 46' acts, via a spring 47, on a spindle 39 which connects two latches 35. The latches 35 are mounted on short bearing journals 43 secured to the rails 42 of the section IV. The bearing journals 43 are situated beneath a transverse end member 44 of the telescopic section III. Each latch 35 is provided with a locking spring 45 arranged on an extension of the associated bearing journal 43, each locking spring acting between the transverse member 44 and the respective latch 35, thereby holding that latch in the locked position. The latches 35 are provided with stops 40 which can engage the rails 42 to prevent the latches from being pivoted too far by the springs 45.

Figure 2:
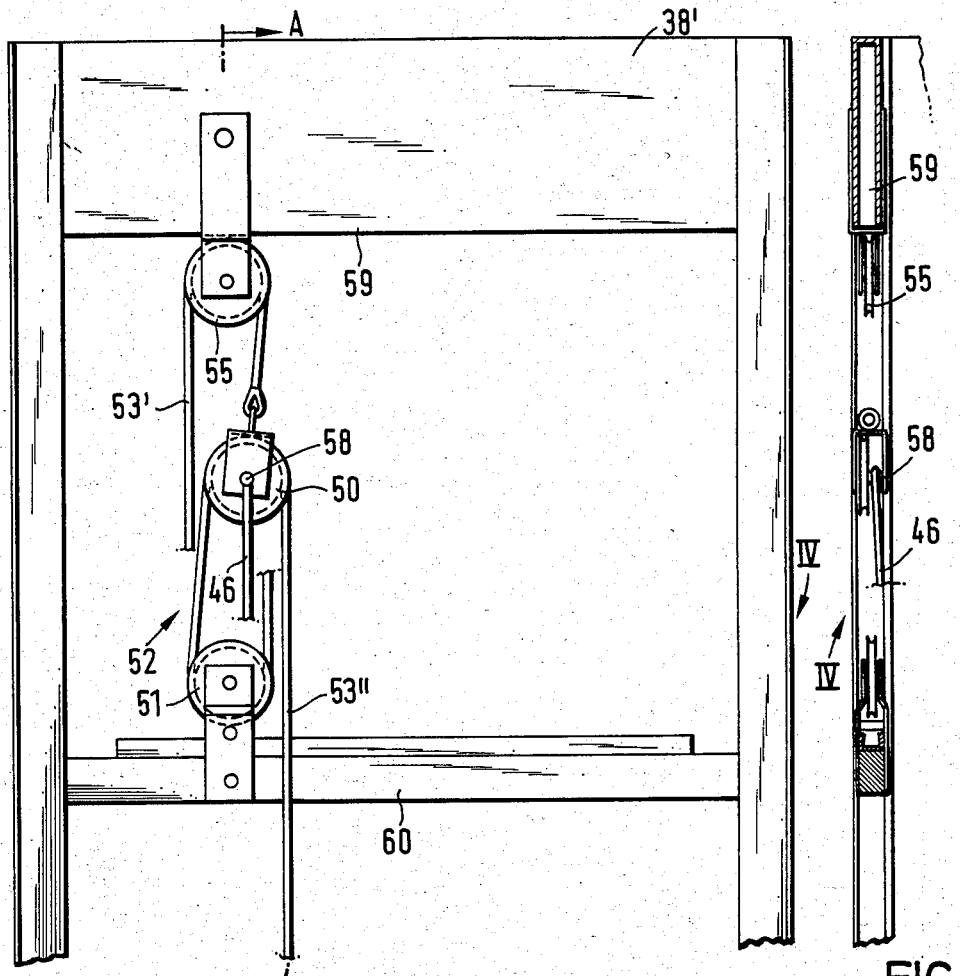
FIG. 2 is a cross-section taken on the line A–B of FIG. 1.

As can be seen from FIG. 2, each latch 35 comprises an inclined face 61 which can slide on the rungs 60 of the adjacent telescopic section against the action of the spring 45. Moreover, as shown in FIG. 4, each latch 35 is provided with an additional stop 41 which is intended to prevent that latch from being pivoted too far on actuation of the release cable 46'. In the locked position, the latches 35 assume the position shown in FIG. 3.

FIG. 5 shows a modified form of latch 36 of saw-tooth formation, and having a plurality of locking dogs 48. The latch 36 is mounted on rocker levers 49 in such a way that the entire latch can be moved aside, by means of the rocker levers, and out of the plane of the adjacent telescopic section, during extension of that section. After running over a rung, the latch 36 can snap in, as described above, in the locking direction. The latch 36 is preferably installed in the free space between the lowermost transverse member 44 of a telescopic section and the adjacent rung 60. Such latch 36 has the advantage that, in each case, it snaps into position after travelling only a short distance.

Figure 7:
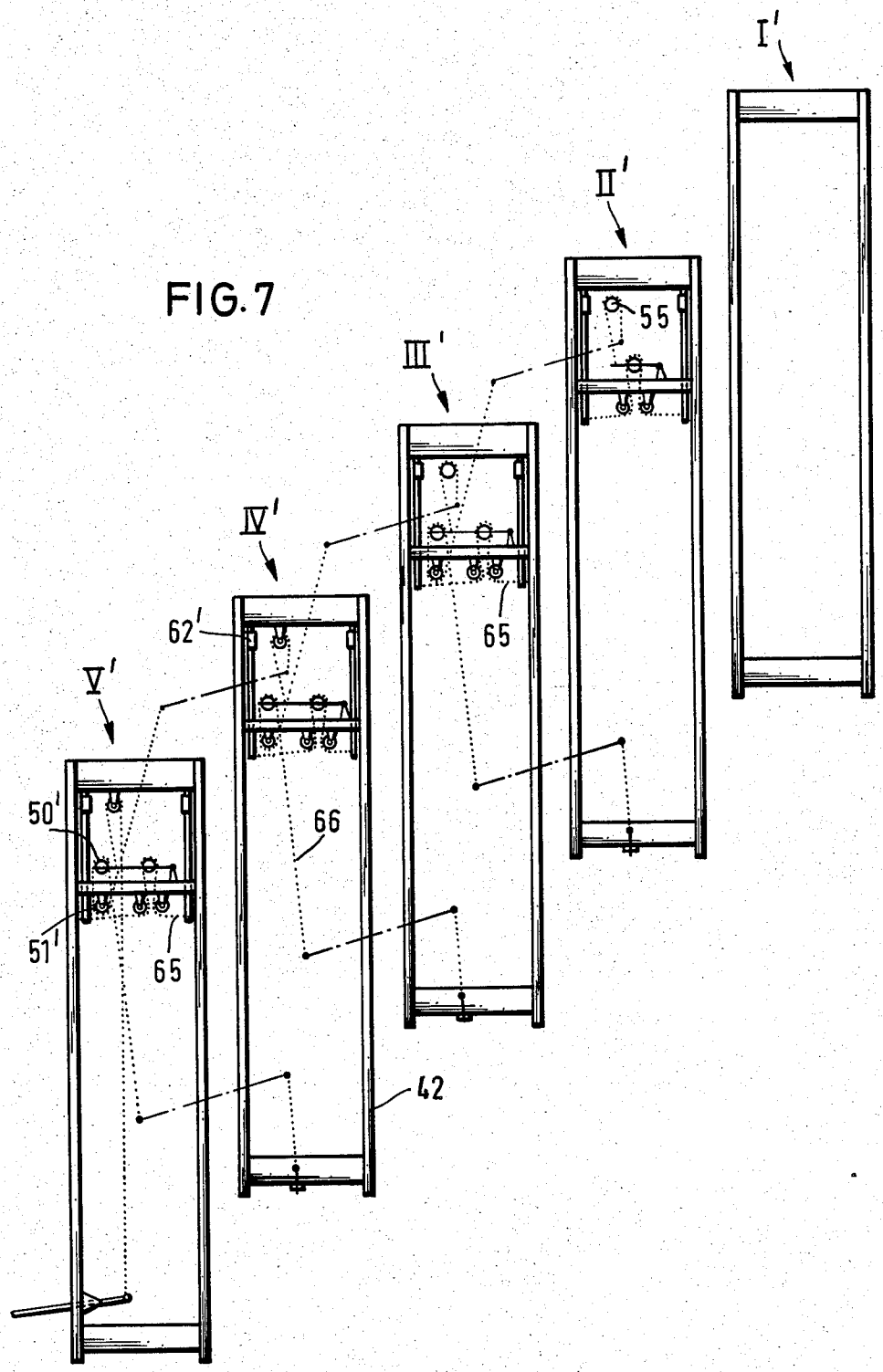
FIG. 7 is an exploded view of the second form of elevator, and shows the cable course of the locking devices.
Figure 8:
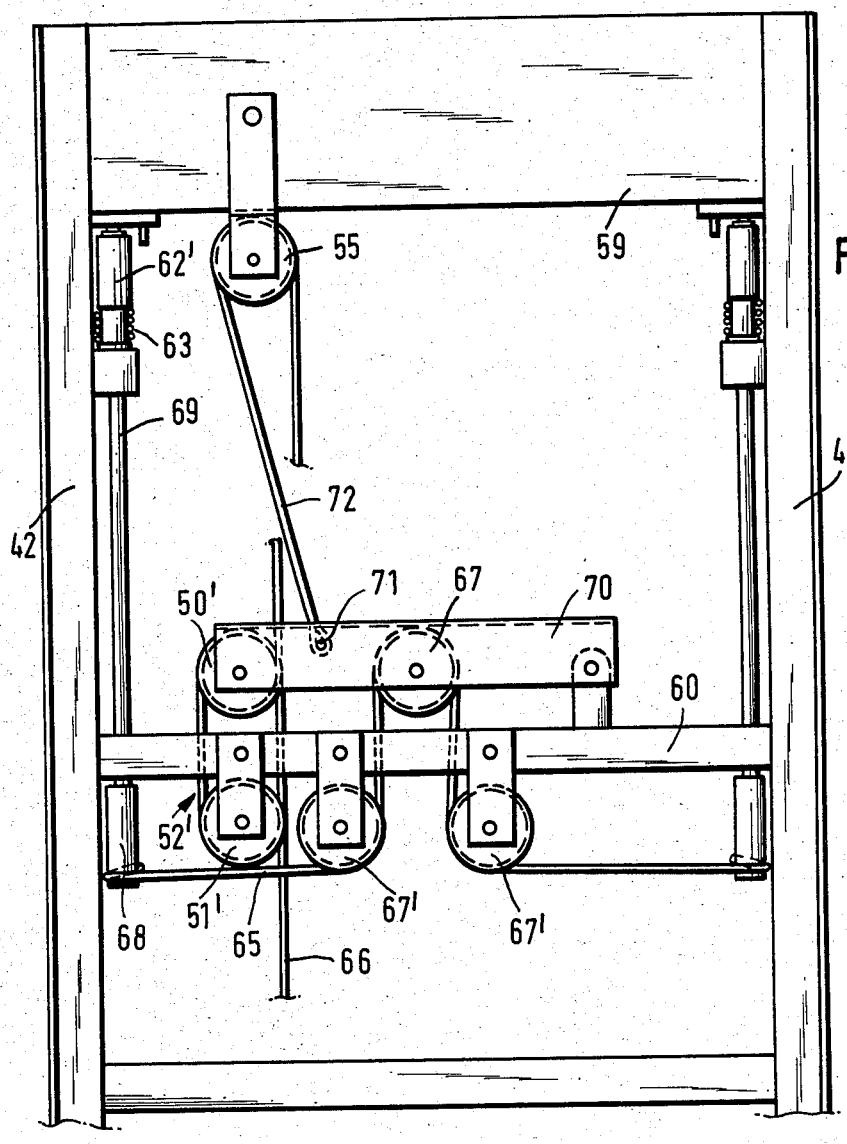
FIG. 8 is a front elevation of the upper end of a telescopic section of the second form of elevator.
Figure 9:
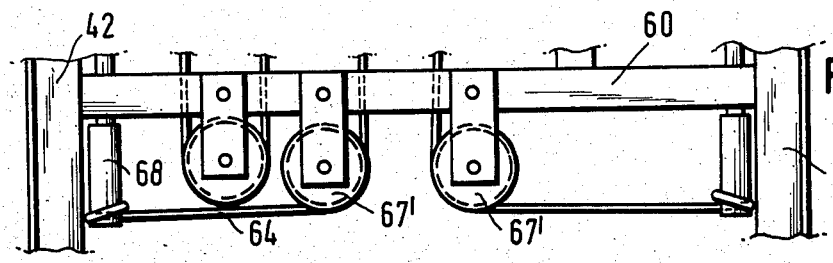
FIG. 9 shows the upper end of the telescopic section of FIG. 8 with a locking cable.

FIGS. 7 to 9 show a modified form of elevator, in which the tackle block is constituted by a fixed pulley 51' and a movable pulley 50'. A draw cable 66 passes round the two pulleys 50' and 51', and then round the reversing pulley 55. Its free end 72 is then fixed to an articulation point 71 provided on a pivotable beam 70 which is rotatably mounted on a rung 60. On shortening of the draw cable 66, the movable pulley 50' will move away from the fixed pulley 51' and, in doing so, entrains a movable pulley 67, so that a locking and/or release cable guided over two fixed reversing pulleys 67' is likewise moved. As shown in FIG. 8, the cable is a release cable 65, that is to say it encloses the stub shafts 68 of dog carriers 69 in such a way that, on actuation of the draw cable 66, locking dogs 62' pivot towards one another into the unlocked position, thereby overcoming the force of a spring 63.

As shown in FIG. 9, this cable is a locking cable 64 which passes around the stub shafts 68 in the opposite direction. In this case, the spring 63 of FIG. 8 would act as a release spring.

I claim:

1. An elevator having a plurality of telescopic sections which are positively guided on one another, each telescopic section being of ladder-like formation having a pair of rails and a plurality of rungs extending between said rails, each pair of adjacent telescopic sections being lockable together by a respective locking device in a plurality of positions of extension, each locking device including a cable-actuated pivotable locking dog associated with one telescopic section of the associated pair of telescopic sections, each locking dog being provided with a support member for the other telescopic section of said pair of telescopic sections, each locking dog being actuated by a respective draw cable which actuates a respective locking/release cable attached to a movably-mounted intermediate member, associated with said other telescopic section of said associated pair of telescopic sections, the improvements comprising constructing each of the locking devices by (a) providing each of the intermediate members with a fixed pulley and a movable pulley, (b) mounting each of the locking dogs for movement in a direction towards an unlocked position and in a direction towards a locked position, movement in one of said directions being a spring-loaded movement, and movement in the other of said directions being under the action of the associated draw cable, (c) connecting each locking/release cable to the associated movable pulley, and (d) passing the draw cable of each telescopic section around the associated fixed pulley and around the associated movable pulley.

2. An elevator according to claim 1, wherein (a) each locking dog is a spring-loaded latch positioned at that end of the associated said one telescopic section adjacent to the associated siad other telescopic section to be locked thereto, each latch being spring-loaded towards the locked position, and (b) each latch is movable towards the unlocked position by a release cable one end of which is attached to the associated movable pulley.

3. An elevator according to claim 2, wherein the other end of each release cable acts on the latch, the associated movable pulley being variable in position by the associated draw cable.

4. An elevator according to claim 2, wherein the fixed pulley and the movable pulley of a given telescopic section serve to guide the draw cable associated with the adjacent telescopic section, the end of said draw cable passing around said fixed pulley leading to the upper end of the adjacent telescopic section, and the end of the cable passing around said movable pulley leading to the lower end of said adjacent telescopic section.

5. An elevator according to claim 3, wherein each latch includes two latching members which are connected together by a rigid spindle, said other end of the associated release cable acting on said spindle.

6. An elevator according to claim 5, wherein each of the latching members is provided with a stop for limiting pivoting of that latching member.

7. An elevator according to claim 5, wherein each of the latching members is rotatably mounted on a bearing journal fixed to a respective rail of the associated telescopic section.

8. An elevator according to claim 7, wherein at least one bearing journal of each locking device serves to mount a locking spring, said locking spring acting between a transverse member of the associated telescopic section and the associated latching member.

9. An elevator according to claim 5, wherein a tension spring is arranged between the spindle and the release cable of each locking device.

10. An elevator according to claim 1, wherein each latch includes a plurality of locking dogs.

11. An elevator according to claim 10, wherein each latch is mounted, via rocker levers, on a rail of the associated telescopic section.

12. An elevator according to claim 1, wherein the free end of each draw cable is attached to an articulation point provided on a pivotable beam, said pivotable beam being articulated to a rung of the associated telescopic section, and serving to mount the movable pulley of the associated locking device.

13. An elevator according to claim 12, wherein the locking/release cable of each locking device is guided between the stub shafts of a dog carrier over reversing pulleys mounted on the associated pivotable beam and on the associated rung.

14. An elevator according to claim 1, wherein each of the telescopic sections extends in common with all the following telescoping sections without relative movement therebetween.

15. An elevator according to claim 1, wherein each of the telescopic sections extends in common with all the following telescopic sections with constant relative movement of said telescopic sections.

16. A locking device for locking together a pair of adjacent telescopic sections of an elevator having a plurality of telescopic sections which are positively guided on one another, each telescopic section being of ladder-like formation having a pair of rails and a plurality of rungs extending between said rails, the locking device including a cable-actuated pivotable locking dog associated with one of said pair of telescopic sections, the locking dog being provided with a support member for the other of said pair of adjacent telescopic sections, the locking dog being actuated by a draw cable which actuates a locking/release cable attached to a movably-mounted intermediate member associated with said other telescopic section, wherein the intermediate member is provided with a fixed pulley and a movable pulley, the locking dog is mounted for movement in a direction towards an unlocked position and in a direction towards a locked position, movement in one of said directions being a spring-loaded movement, and movement in the other of said directions being under the action of the draw cable, the locking/release cable being connected to the movable pulley, and the draw cable passing around the fixed pulley and around the movable pulley.

* * * * *